US011788262B2

(12) United States Patent
Tracy et al.

(10) Patent No.: US 11,788,262 B2
(45) Date of Patent: Oct. 17, 2023

(54) SOFT-CLOSE SPRAY HEAD FAUCET

(71) Applicant: ASSA ABLOY Americas Residential Inc., New Haven, CT (US)

(72) Inventors: Adam William Tracy, Irvine, CA (US); Evan Benstead, Los Angeles, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 0 days.

(21) Appl. No.: 17/741,554

(22) Filed: May 11, 2022

(65) Prior Publication Data

US 2022/0364340 A1 Nov. 17, 2022

Related U.S. Application Data

(60) Provisional application No. 63/187,602, filed on May 12, 2021.

(51) Int. Cl.
*E03C 1/04* (2006.01)

(52) U.S. Cl.
CPC ..... *E03C 1/0404* (2013.01); *E03C 1/0403* (2013.01); *E03C 2001/0415* (2013.01)

(58) Field of Classification Search
CPC ..... E03C 1/0404; E03C 1/0403; E03C 2001/0415
See application file for complete search history.

(56) References Cited

U.S. PATENT DOCUMENTS

| | | | | |
|---|---|---|---|---|
| 9,850,642 | B2 * | 12/2017 | Enlow | E03C 1/0404 |
| 2008/0196160 | A1 * | 8/2008 | Alder | F16L 11/16 4/678 |
| 2010/0043135 | A1 * | 2/2010 | Patterson | E03C 1/06 4/612 |
| 2012/0042973 | A1 * | 2/2012 | Ko | E03C 1/0404 137/801 |
| 2016/0215482 | A1 * | 7/2016 | Fourman | E03C 1/0404 |
| 2018/0030700 | A1 * | 2/2018 | Zindler | E03C 1/0405 |
| 2020/0048879 | A1 * | 2/2020 | Hadfield | E03C 1/0404 |
| 2020/0063408 | A1 | 2/2020 | Tracy et al. | |
| 2020/0240125 | A1 * | 7/2020 | Harrison | E03C 1/0404 |

* cited by examiner

*Primary Examiner* — Patrick C Williams
(74) *Attorney, Agent, or Firm* — Merchant & Gould P.C.

(57) ABSTRACT

A slow close faucet assembly includes a magnetic collar and a linear damper mechanism. The magnetic collar is fixedly attachable to a hose of a faucet. The linear damper mechanism has a body portion, a base portion, and a top portion. The linear damper mechanism further includes at least one damper and a damper bar. The at least one damper has a first end and a second end connected to the base portion. The linear damper bar houses a magnet and is located at the top portion of the linear damper mechanism and is connected to the first end of the at least one damper. The linear damper bar is capable of moving relative to the base portion. The magnetic collar is movable relative to the linear damper mechanism as the hose moves between a retracted position and an extended position.

21 Claims, 8 Drawing Sheets

SOFT-CLOSE SPRAY HEAD FAUCET

CROSS-REFERENCE TO RELATED APPLICATIONS

This application claims priority to and the benefit of U.S. Provisional Application No. 63/187,602, filed May 12, 2021, which is hereby incorporated by reference herein in its entirety.

TECHNICAL FIELD

This invention relates to the field of faucets. In particular, this invention relates to a device and method for a soft-close retractable faucet.

BACKGROUND

Many faucets, such as kitchen faucets, include a retractable spray hose with a spray nozzle. The spray nozzle may be provided on a retractable, pull-out spray head, which allows the user to direct water flow from the pull-out head toward destinations where the flow is useful and where conventional faucets may not reach. For example, when washing pots and pans, the user may pull out the head and direct the flow into the pots and pans rather than moving the pots and pans under the faucet. Because the pull-out head is typically much lighter and much easier to negotiate than the item that is being washed, this adds to user convenience.

Presently, kitchen spray heads on pull-down faucets retract when a user releases the spray head. This may be accomplished, conventionally, using a weight that is positioned on a hose that is connected to the spray head, and which is located below a countertop and/or sink. When released by a user, the spray head retracts back toward the spout tube as the hose is pulled back through the spout tube by the weight. The spray head stops moving when the spray head has reached the spout tube.

This arrangement is convenient, but has some disadvantages. For example, the sharp and/or repeated impact of the spray head on the spout tube can cause damage to the spray head, leading to leaks or lack of performance from the spray head. The impact on the spray head is generally located in a vulnerable location of the spray head, where a water hose attaches to the spray head. Any damage to this connection point can lead to a leak and/or water damage beneath the sink. Accordingly, in many cases, the weight applied to the hose must be selected such that it is not unduly difficult for a user to pull out the spray head and hose for use, and so that the impact of the spray head on the spout tube caused by the retracting force of the weight does not cause damage. Furthermore, the impact of the collision between the spray head and the spout tube not only provides the potential for damage, it is aesthetically unpleasing to experience for a user. Accordingly, some users will deliberately, manually re-seat the spray head into contact with the spout tube to avoid such collisions. This adds a level of implicit potential inconvenience to the user.

SUMMARY

In general terms, this disclosure is related to a faucet having a retractable spray head with a slow close feature.

In a first aspect, a faucet comprising a faucet base, a faucet spray head, a hose, a magnetic collar, and a linear damper mechanism are described. The faucet spout has an interior passage, a first end connected to the faucet base, and a second end. The faucet spray head is movable between a spray head retracted position in which the spray head is proximate to the second end of the faucet spout, and a spray head extended position positioned away from the second end. The hose extends through the interior passage of the faucet spout, and has a first end that is connected to a water source and a second end that is connected to the faucet spray head. The hose extends through the faucet spout. The magnetic collar is affixed to the hose. A linear damper mechanism includes at least one damper having a portion movable between a damper compressed position and a damper extended position and a damper plate. The damper plate is engaged to the at least one damper and has a bore sized to accept the hose and allow the hose to slide therethrough. The bore has a diameter smaller than a width of the magnetic collar. The damper plate includes a magnet. When the faucet spray head is in the spray head extended position, the damper is moved to the damper extended position and as the faucet spray head is retracted toward the spray head retracted position, the damper is engaged by contact between the magnetic collar and the damper plate, thereby slowing retraction of the spray head until the spray head is in the spray head retracted position and the at least one damper is in the damper compressed position.

In another aspect, a faucet comprising a faucet base, a faucet spout, a faucet spray head, a hose, and a linear damper mechanism are described. The faucet spout has an interior passage, a first end connected to the faucet base, and a second end. The faucet spray head is movable between a spray head retracted position in which the spray head is proximate to the second end of the faucet spout, and a spray head extended position positioned away from the second end. The hose extends through the interior passage of the faucet spout. The hose has a magnetic collar attached to a first end that is connected to a water source and a second end connected to the faucet spray head. The hose extends through the faucet spout. The linear damper mechanism has at least one damper having a portion movable between a damper compressed position and a damper extended position. The linear damper mechanism also includes a base plate engaged to the at least one damper via a damper bar. The base plate has a bore sized to accept the hose and allow the hose to slide therethrough. The bore has a diameter smaller than a width of the magnetic collar. The base plate also includes a magnet. When the faucet spray head is in the spray head extended position, the at least one damper is moved to the damper extended position and as the faucet spray head is retracted toward the spray head retracted position, the at least one damper is engaged by contact between the magnetic collar and the base plate, thereby slowing retraction of the spray head until the spray head is in the spray head retracted position and the at least one damper is in the damper compressed position.

In yet another aspect, a slow close faucet assembly is described. The slow close faucet assembly includes a magnetic collar and a linear damper mechanism. The magnetic collar is fixedly attachable to a hose of the faucet. The linear damper mechanism has a body portion, a base portion, and a top portion. The linear damper mechanism further includes at least one damper and a damper bar. The at least one damper has a first end and a second end connected to the base portion. The linear damper bar houses a magnet and is located at the top portion of the linear damper mechanism and is connected to a first end of the at least one damper. The damper bar is capable of moving relative to the base portion.

The magnetic collar is movable relative to the linear damper mechanism as the hose moves between a retracted position and an extended position.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
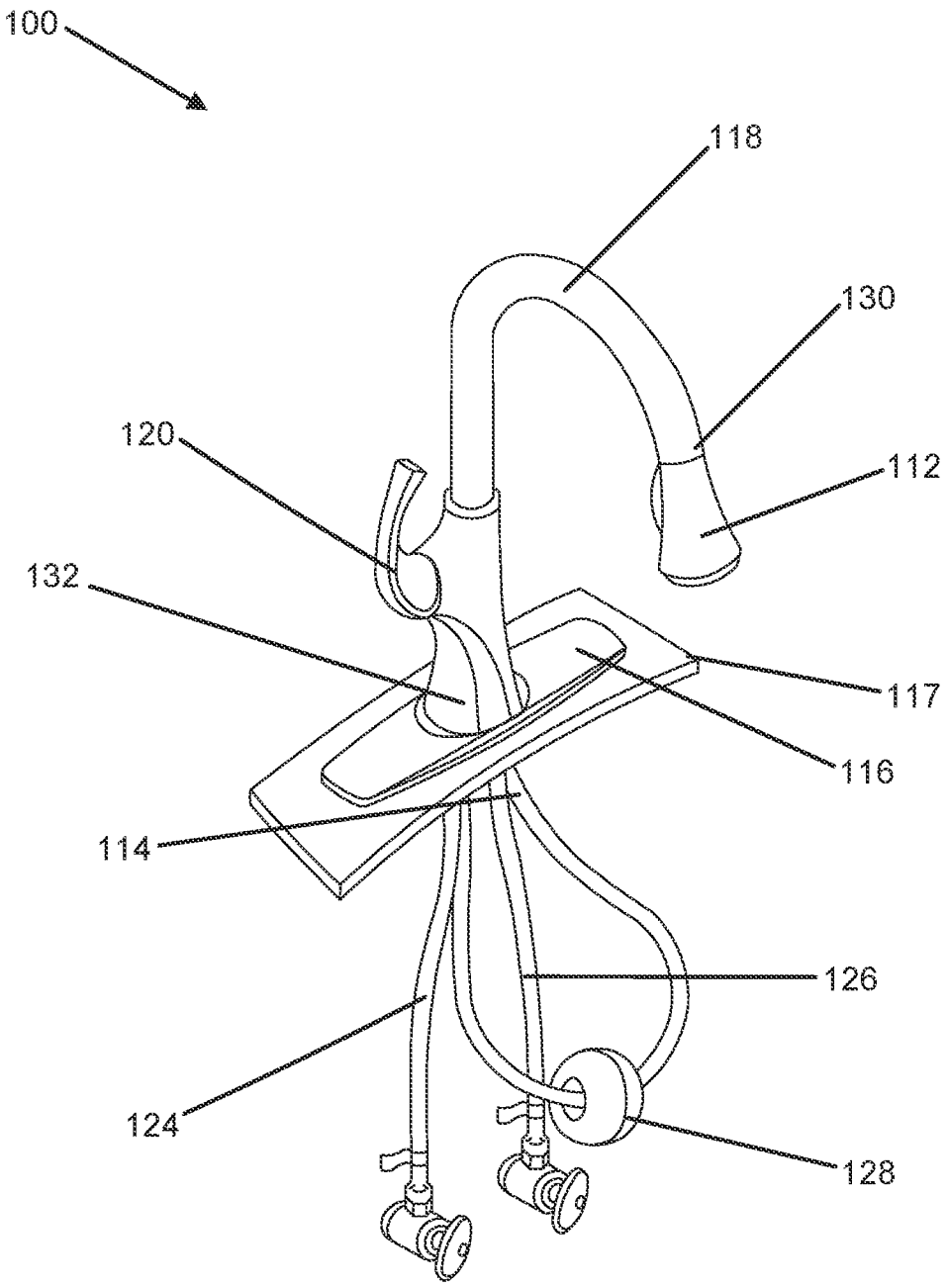
FIG. 1 illustrates a perspective view of a faucet with a retractable spray head in accordance with the present disclosure.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

In general, the present disclosure is directed to a pull-down or pull-out faucet having a "soft-close" feature, e.g., dampening the impact or recoil effect caused by a weight on a hose and spray head that has been pulled away from a faucet spout. In particular, a magnetic effect caused by the magnetic collar nearing the magnet located in the linear damper bar is used to initially slow retraction of the faucet spout and/or hose. Then, a viscous friction effect of the at least one damper further reduces the retraction speed of the spray head at it nears the second end of the spout. As the hose approaches a docked position (e.g., when released by a user from a pull-out position), the magnetic effect in combination with the viscous friction effect may slow the retraction of the spray head, thereby gently returning it to its original seated (retracted) position.

FIG. 1 illustrates a representative faucet 100 in which a soft-close feature can be implemented. FIG. 1 specifically shows a perspective view of a faucet 100 including a faucet spray head 112 configured in accordance with the present invention. The faucet 100 may be mounted, for example, to a kitchen sink or to other sink structures, such as for example, a utility sink or a bathroom tub.

In the example shown, the faucet 100 includes a base 116, a faucet spout 118, and a water controller 120. In alternative examples, multiple water controllers 120 may be used, wherein a first water controller controls hot water and a second water controller controls cold water. Hot and cold water conduits 124, 126, respectively, such as for example, copper pipes or plastic tubing, connect the faucet 100 to a water source (not shown). The faucet spout 118 is connected at a first end 132 to the base 116 and at a second end 130 to the faucet spray head 112. A hose 114 supplies a flow of water, including hot and/or cold water, in proportions as selected by the water controller 120.

Hot and cold water conduits 124, 126 lead to a cartridge (not shown, typically within a handle and/or base 116), with water flow controlled by the water controller 120. The cartridge is fluidically connected to the hose 114 that extends through the faucet spout 118 to the faucet spray head 112. As such, the hose 114 is connected at one end, indirectly, to a water source (via hot and cold water conduits 124, 126) and at an opposite end to the faucet spray head 112.

In the embodiment shown, the faucet 100 is mounted to a sink deck 117 (a portion of which is shown), which is also referred to as a sink deck or countertop. The base 116 is mounted above the sink deck 117, and hot and cold water conduits 124, 126 lead through the base 116 to the cartridge, with the hose 114 extending back down through the sink deck 117 and up through the faucet spout 118 to the faucet spray head 112. A hose weight 128 is placed around the hose 114, below the sink deck 117. The hose weight 128 is located below the base 116 and slides along the hose 114. The hose weight 128 provides a pulling force on the hose 114 to cause the faucet spray head 112 to retract into the faucet spout 118 utilizing gravity.

The faucet 100 includes the faucet spray head 112 that is detachable from the second end 130 of the faucet spout 118. As shown, the faucet spray head 112 is in a retracted position, where the faucet spray head 112 is docked at the second end 130 of the faucet spout 118. In an extended position, the faucet spray head 112 is movable away from the second end 130 of the faucet spout 118 so as to allow a user the ability to manipulate the faucet spray head 112 during use. This is facilitated by the hose 114 having excess length attached to the faucet spray head 112 and being extendable through the faucet spout 118, with additional slack hose being stored under the sink deck 117.

The hose weight 128 is positionable around the hose 114 (as shown in FIG. 1) to urge the faucet spray head 112 to the retracted position. In example embodiments, the hose weight 128 slides along the hose 114 as the faucet spray head 112 is pulled away from the second end 130 of the faucet spout 118. The hose weight 128 has a weight that is greater than the weight of the faucet spray head 112, which allows the hose weight 128 to pull the faucet spray head 112 back into the retracted position.

In use, a user pulls the faucet spray head 112 away from the faucet spout 118, moving the faucet spray head 112 from the retracted position to the extended position. When the user releases the faucet spray head 112, the hose weight 128 causes the faucet spray head 112 to retract back toward the retracted position at the second end 130 of the faucet spout 118.

In example embodiments, the faucet spray head 112 may be fitted with one or more alignment features, such that, when a user releases the faucet spray head 112 from an extended position and it retracts toward the second end 130 of the faucet spout 118, the faucet spray head 112 returns to a predetermined alignment. Details regarding an example alignment feature usable in a pull-out faucet are provided in U.S. Patent Publication No. 20200063408, entitled "Faucet Head Alignment System", which is hereby incorporated by reference in its entirety.

The faucet 100 can, in the various embodiments described herein, include a soft-close feature. This feature, as described in more detail below, is usable in a pull-down or pull-out faucet, and decreases the speed at which the faucet spray head 112 is retracted back to the second end 130 of the faucet spout 118 for at least a portion of the distance that the faucet spray head 112 retracts to the faucet spout 118. The soft-close feature comprises, in some embodiments, a magnetic collar attached to a hose 114 of the faucet 100, at a fixed distance away from the faucet spray head 112. As the faucet spray head 112 is released and moves towards the retracted position, the magnetic collar moves toward a linear damper bar that also includes a magnet. When the magnetic collar nears the magnet, the speed of retraction of the hose 114 is slowed. Then, the linear damper bar "catches" the hose 114 and the retraction is slowed via the linear damper mechanism. The linear damper mechanism causes the speed of the faucet spray head 112 to decrease as it is retracted back to the faucet spout 118.

In many embodiments, the relative positions of the magnetic collar and the linear damper bar are such that, as a faucet spray head 112 is released, it may retract without any damping effect until the spray head approaches the second end 130 of the faucet spout. As the faucet spray head 112 approaches the second end 130 (e.g., within 1-3 inches of contact with the second end), the linear damper mechanism may initiate a retraction dampening effect as discussed below.

The soft-close feature may be implemented on a variety of faucets, including, but not limited to, kitchen faucets and tub faucets. Further, the faucet 100 is configured to be controlled (i.e., on/off, water volume, and water temperature) via traditional methods (e.g., a handle as seen in FIG. 1), and/or via gesture or voice.

Although this disclosure will be discussed with regard to a kitchen faucet for purposes of example, the system described herein could be implemented in any type of pull-down faucet and/or a pull-out faucet, including a side auxiliary spray faucet. In some examples, the faucet 100 is a showerhead in a shower or a pull-out faucet for a tub in a bathroom. In some examples, the faucet 100 is any fluid dispensing device that is configured to dispense fluid therefrom.

Figure 2:
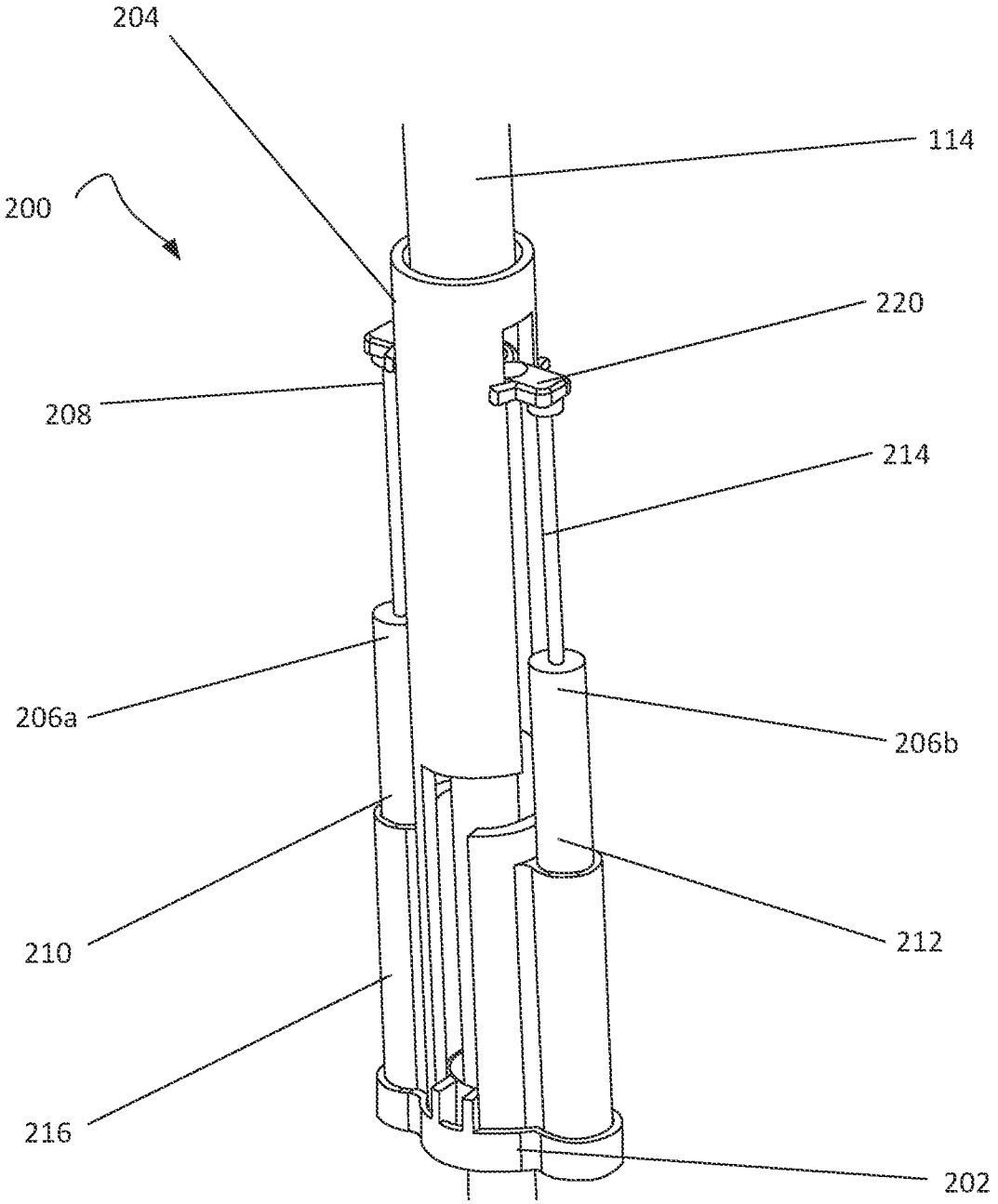
FIG. 2 illustrates an isolated view of the linear damper mechanism with a linear damper bar with magnets.

FIG. 2 illustrates an isolated view of a linear damper mechanism 200 of the faucet 100, according to one example embodiment. In the embodiment as shown, the liner damper mechanism is in an extended position wherein the linear damper plate 220 is located at a maximum distance away from the base portion 202. The linear damper mechanism 200 has a body portion 216, a base portion 202, and a top portion 204. The linear damper mechanism 200 also includes at least one damper 206. As shown, a first linear damper **206*a* is located on a first side of the linear damper mechanism 200 and a second linear damper 206*b* is located on a second side of the linear damper mechanism 200**.

Each damper **206*a*, 206*b* has a first end 208 connected to a linear damper plate 220, and a second end 210 connected to the base portion 202 of the linear damper mechanism 200. Each damper 206*a*, 206*b* includes a damper body 212 and a damper rod 214. The damper rod 214 extends from the damper body 212 in an extended position, and the damper rod 214 retracts into the damper body 212** in a retracted position.

The damper 206 can be a mechanical damper device, such as a dashpot. For example, the damper body 212 may include a space into which the damper rod 214 extends. The damper 206, in combination with the magnetic effect between a magnetic collar 230 and a magnet 222 (both shown in FIG. 3) offset the velocity of the faucet spray head 112 moving back toward the faucet body caused by the hose weight 128.

The linear damper mechanism 200 also includes the linear damper plate 220 at the top portion 204. In some embodiments, the linear damper plate 220 includes a magnet 222 that is capable of interacting with a magnetic collar 230 fixedly connected to the hose 114. The linear damper plate 220 also includes a bore hole 224 (shown in FIG. 3) that is capable of accepting and allowing the hose 114 to move freely therethrough. The bore hole 224 has an inner diameter that allows the hose 114 to move freely therethrough, but not the magnetic collar attached to the hose 114. The magnetic collar has an outer diameter that is greater than the inner diameter of the bore hole 224, and therefore cannot move through the bore hole 224.

In the embodiments described herein, the bore hole 224 is ring shaped so the hose 114 but not the magnetic collar 230 are capable of extending therethrough. The magnet 222 may be located around the circumference of the bore hole 224, or may be located at a single point along the circumference of the bore hole 224. The linear damper plate 220 may include a single magnet 222, or may include multiple magnets 222.

In an alternative embodiment, the linear damper plate 220 is magnetic itself, and does not include an additional magnet 222.

The magnetic collar 230 is fixedly attached to the hose 114, so it is stationary and does not move along the hose, even as the hose 114 moves through the faucet 110 when a user pulls on the spray head 112. The magnetic collar 230 may be attached directly to the hose 114, and comprises a magnet. The magnet may be located around the circumference of the hose 114, or may be located at a single point along the circumference of the hose 114. The magnetic collar 230 may include a single magnet, or may include multiple magnets. In an alternative embodiment, the magnetic collar 230 is magnetic itself, and does not include an additional magnet.

The magnetic collar 230 may be connected to the hose 114 mechanically, such as with a clamp, or with epoxy or glue. The magnetic collar 230 is located along the hose 114 at a point where the magnetic collar 230 is located at least adjacent the linear damper plate 220 when the spray head 112 is in the retracted position. The inner diameter of a magnetic collar 230 is sized to fit around a standard faucet hose 114. For example, the inner diameter of the magnetic collar 230 may be about ½ inch or about ⅜ inch. The magnetic collar 230 may have a diameter of up to about 2 inches.

In use, a user pulls the faucet spray head 112 from the second end 130 of the spout 118 of the faucet 100. As the user pulls the faucet spray head 112, the hose 114 is fed through the bore hole 224 of the linear damper plate 220. At the same time, the linear damper plate 220 and the connected damper rod 214 extend from the damper body 212 to a maximum distance away from the base portion 202. A user pulling on the spray head 112 is able to overcome both the force of the damper 206 and the magnet effect to pull the spray head 112 to a desired distance away from the second end 130 of the spout 118.

When a user lets go of the faucet spray head 112, the hose weight 128 causes the faucet spray head 112 to retract back to the faucet spout 118. As the hose 114 moves through the linear damper plate 220, the magnetic collar 230 nears the magnet 222 of the linear damper plate 220. The magnetic attraction between the magnetic collar 230 and the magnet 222 causes the hose 114 to decrease in speed. Specifically, the magnetic collar 230 attaches magnetically to the linear damper plate 220 at the magnet 222, and, during a remaining retraction distance, retraction occurs by the hose weight 128 pulling against a dampening force of damper 206. This reduces the speed that the faucet spray head 112 retracts. That is, once the magnetic collar 230 reaches the magnet 222 of the linear damper plate 220, the damper 206 takes over the slow close process, with the damper rod 214 retracting back into the damper body 212 in a slow and controlled movement.

The magnetic attraction between the magnetic collar 230 and the magnet 222 also reduces any potential "bounce" associated with the impact that may occur when the magnetic collar 230 "hits" the linear damper plate 220.

In a configuration where the faucet spray head 112 is in an extended position, the magnetic collar of the hose 114 is located a distance away from the linear damper plate 220, where there is no (or minimal) magnetic attraction between the magnetic collar 230 and the magnet 222. At the same time, the linear damper plate 220 is located at a maximum distance from the base portion 202 of the linear damper mechanism 200. In other words, the damper rods 214*a*, 214*b* are extended relative to the damper body 212 of each damper 206.

In a configuration where the faucet spray head 112 is in a retracted position, the magnetic collar 230 of the hose 114 is located adjacent the linear damper plate 220. At the same time, the linear damper plate 220 is located at a minimum distance from the base portion 202 of the linear damper mechanism 200. In other words, the damper rods 214*a*, 214*b* are retracted relative to the damper body 212 of each damper 206.

Figure 3:
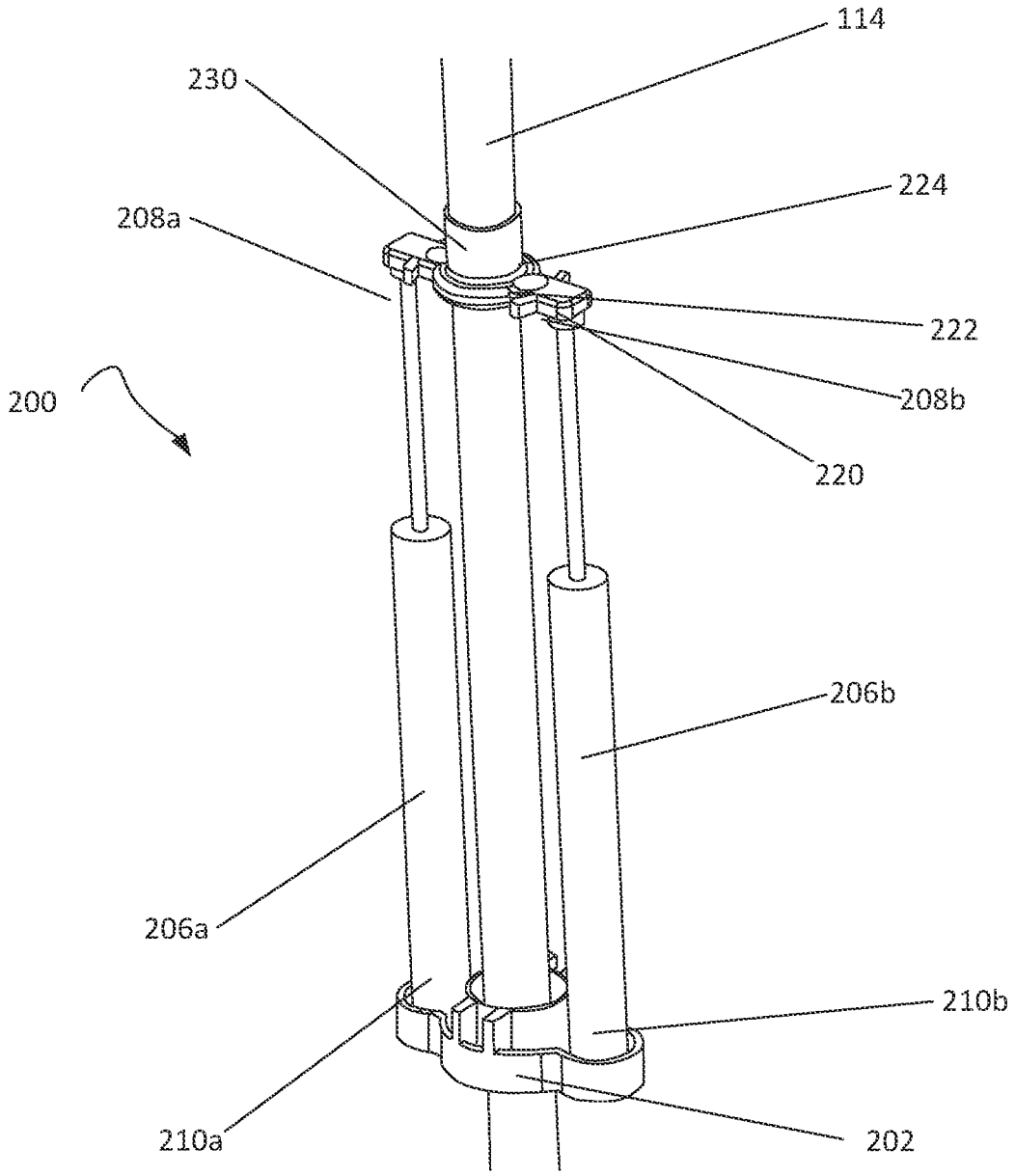
FIG. 3 illustrates a cut away view of the linear damper mechanism.

FIG. 3 shows a view of the linear damper mechanism 200 with the body portion 216 (shown in FIG. 2) of the linear damper mechanism 200 removed. In the embodiment shown, the linear damper mechanism 200 is shown in an compressed position, wherein the linear damper plate 220 is located at a minimum distance away from the base portion 202. It should be noted that while the magnetic collar 230 is located adjacent the linear damper plate 220, when the faucet spray head 112 is in an extended position, the magnetic collar 230 may be located a greater distance away from the linear damper plate 220.

The linear damper mechanism 200 includes a first damper 206*a* and a second damper 206*b*, wherein the second end 210*a*, 210*b* of each damper 206*a*, 206*b* is attached to the base portion 202. A first end 208*a*, 208*b* of each damper 206*a*, 206*b* is attached to the linear damper plate 220, and the linear damper plate 220 is located at the top portion 204 of the linear damper mechanism 200.

The linear damper plate 220 includes a magnet 222 that is located at a position capable of communicating with the magnetic collar 230 of the hose 114. The linear damper plate 220 includes the bore hole 224 that allows the hose 114 to move freely therethrough. While the hose 114 is able to move freely within the bore hole 224, the magnetic collar 230 cannot move through the bore hole 224. As discussed above, the bore hole 224 has an inner diameter that allows the hose 114 to move freely therethrough, but not the magnetic collar 230 attached to the hose 114. Therefore, when the magnetic collar 230 reaches the bore hole 224, the retraction speed of the spray head 112 is reduced by the dampers 206*a*, 206*b*.

The dampers 206*a*, 206*b* have an extended position and a retracted position. In an extended position as shown, the damper rod 214 extends in a maximum distance from the damper body 212. As noted above, the extended distance of damper rod 214 may vary in different embodiments, but may be in the range of 1-3 inches.

Figure 4:
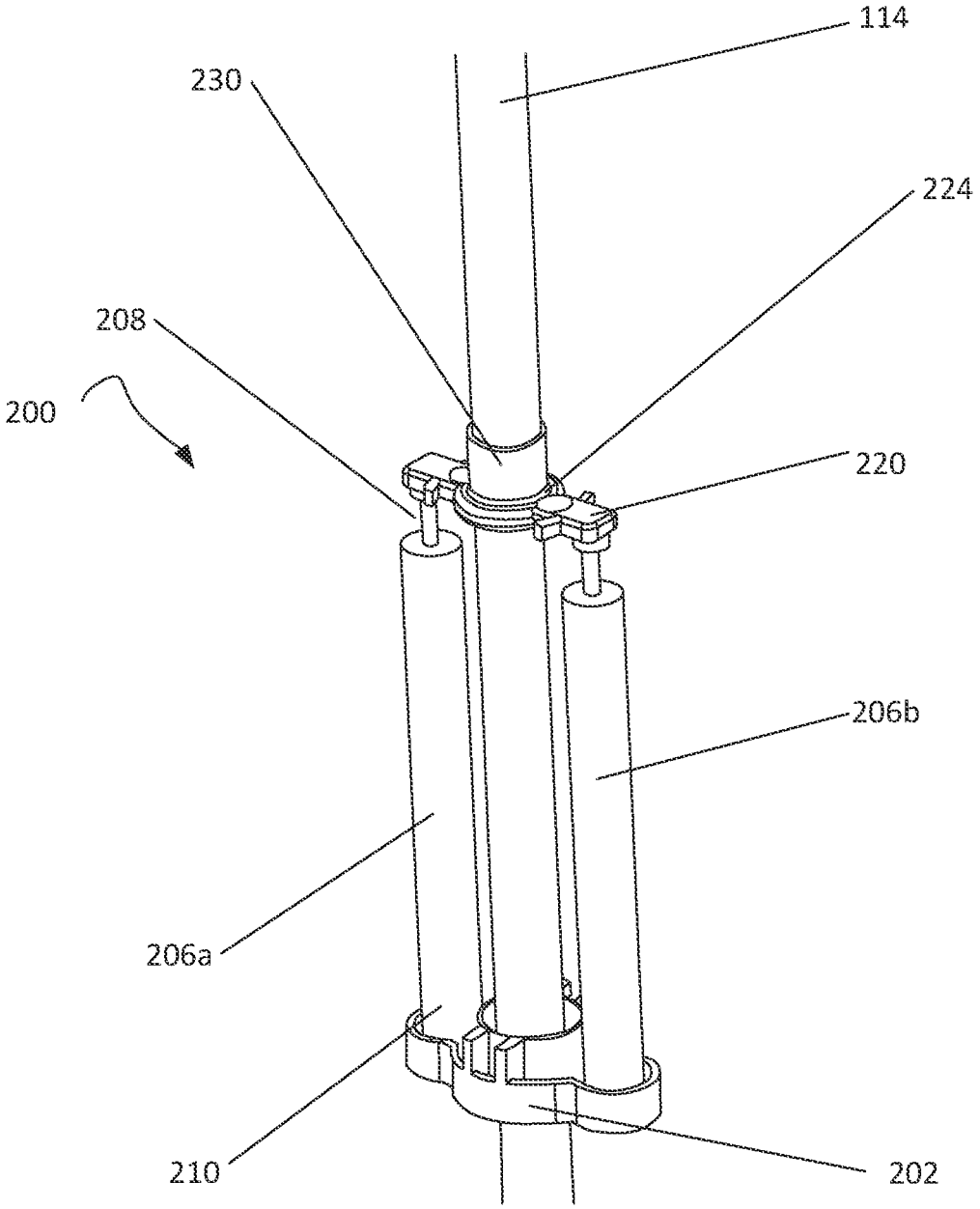
FIG. 4 illustrates another cut away view of the linear damper mechanism.

FIG. 4 illustrates another view of the linear damper mechanism 200 with the body portion 216 (shown in FIG. 2) removed, and in a retracted position. In the retracted position, the linear damper plate 220 is located at a minimum distance from the base portion 202. The dampers 206*a*, 206*b* are in a retracted position. In a retracted position, the damper rod 214 extends at a minimum distance from the damper body 212. The length of the damper body 212 does not change. As the linear damper plate 220 catches the magnetic collar 230 that is attached to the hose 114, the damper rod 214 retracts into the damper body 212 at a slow and controlled speed.

Figure 5:
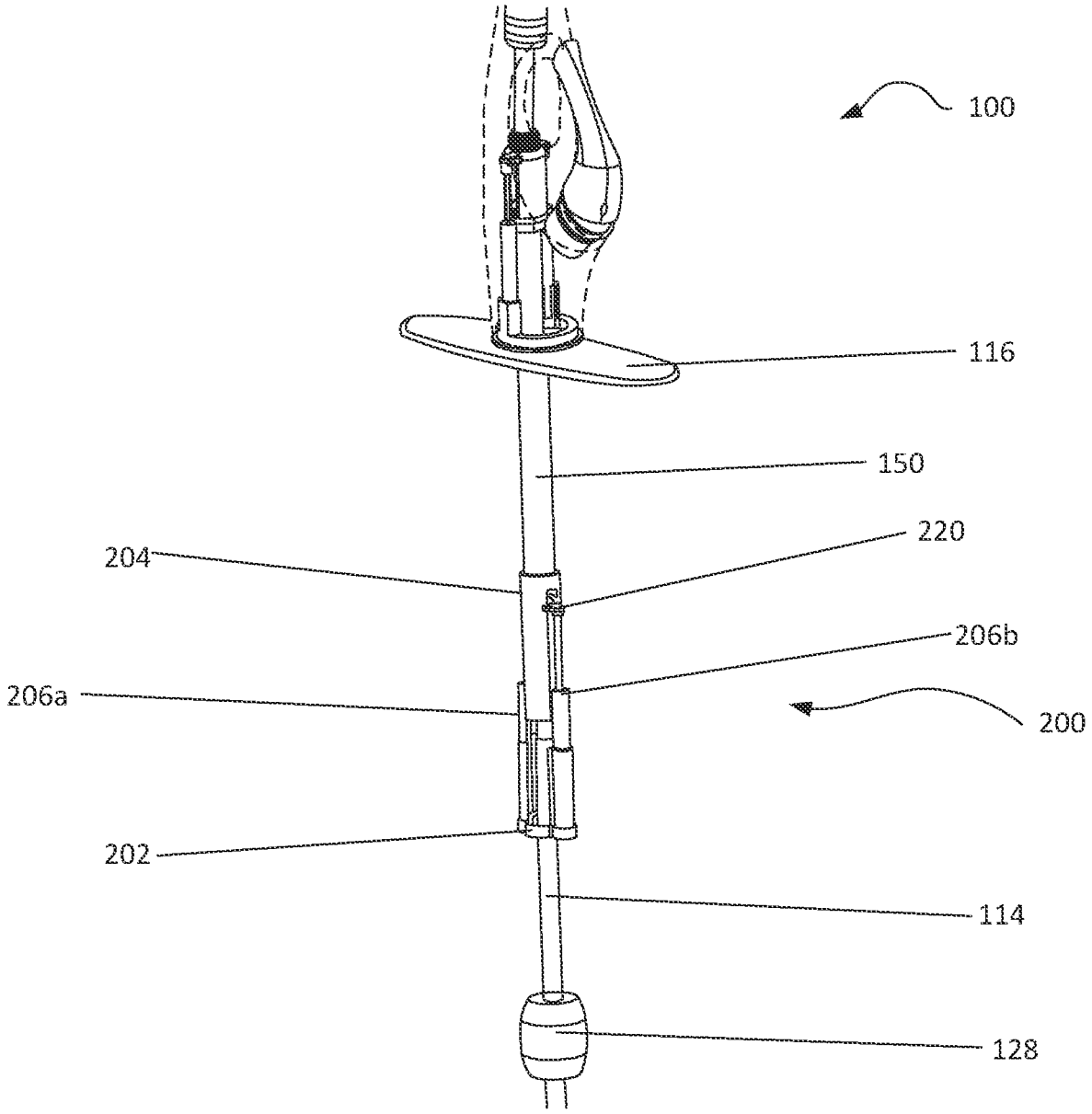
FIG. 5 illustrates a linear damper attached to a shank of the faucet.

FIG. 5 illustrates an example embodiment of the linear damper mechanism 200 located below a sink deck 117 (shown in FIG. 1) on which the faucet 100 is installed. A linear damper mechanism 200 can be retrofitted to a faucet 100 by being installed below the sink deck 117. As shown, the linear damper mechanism 200 can be located at a distance below the base 116 of the faucet 100. The location of the linear damper mechanism 200 must be such that the faucet spray head 112 can be moved a desired amount by the user without the hose weight 128 coming into contact with the base portion 202 of the linear damper mechanism 200. In some examples, the linear damper mechanism is installable on a threaded shank 150 extending below the sink deck 117, and may be threaded thereon.

As shown, the linear damper mechanism 200 includes a first damper 206*a* and a second damper 206*b*. However, in other embodiments, a single damper 206 may be utilized.

Figure 6:
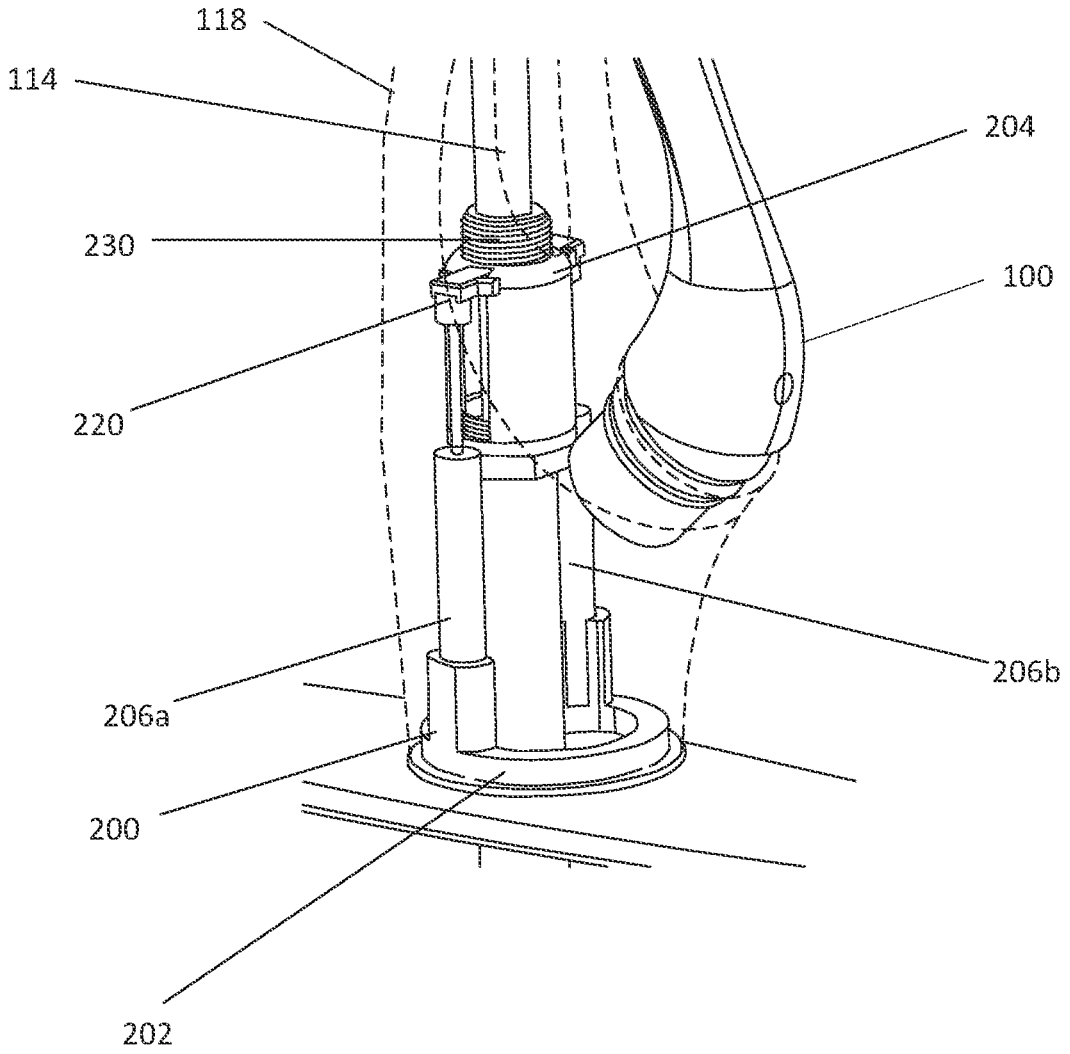
FIG. 6 illustrates a linear damper within a faucet body.

FIG. 6 illustrates an example embodiment of the linear damper mechanism 200 located within a faucet spout 118 of the faucet 100. In such an example, the linear damper mechanism 200 may be manufactured as part of the faucet 100. The linear damper mechanism 200 includes the first and second dampers 206*a*, 206*b* extending from the base portion 202 at the second end 210. The first end 208 of the dampers 206*a*, 206*b* is attached to the linear damper plate 220. Again, the linear damper mechanism 200 may only include a single damper 206.

Figure 7:
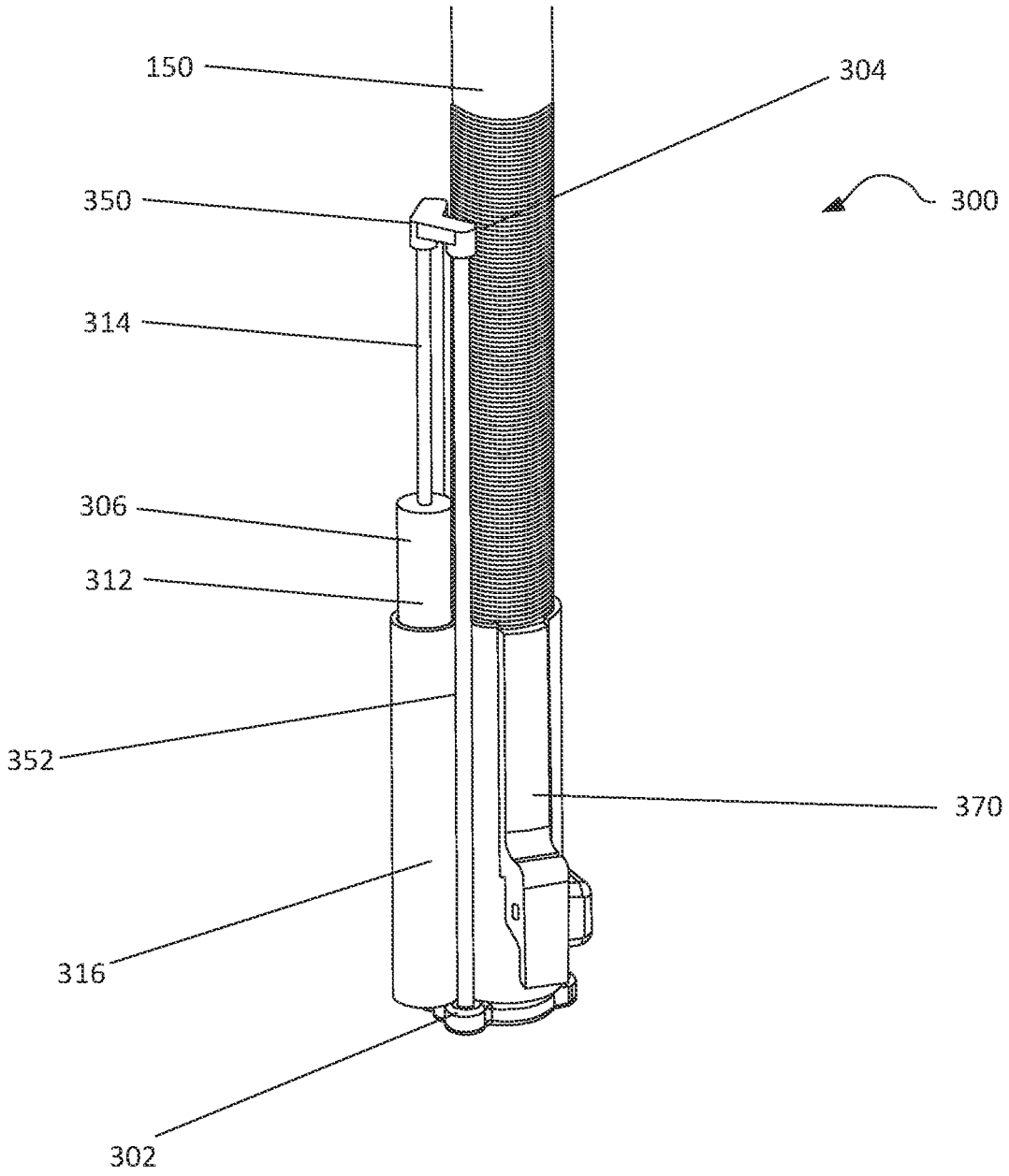
FIG. 7 illustrates an alternative embodiment of the linear damper mechanism.

FIG. 7 illustrates an alternative embodiment of the linear damper mechanism 300. The linear damper mechanism 300 shown can be installed under a sink deck of the faucet 100 where it is retrofitted to a faucet 100. Alternatively, the linear damper mechanism 300 can be manufactured as part of the faucet 100, where it is located within the base 116.

The linear damper mechanism 300 as shown includes a single damper 306 housed within a body portion 316 of the linear damper mechanism 300. The damper 306 includes a damper body 312 that is attached to a base plate 302, and a damper rod 314 extending to a damper plate 350 located at a top portion 304 of the linear damper mechanism 300.

In this example, the base plate 302 includes a magnet (not shown) that is capable of communicating with a magnetic collar 230 of the hose 114. In this example, the hose (not shown) extends through a shank 150 that extends down through a sink deck 117 when installed.

In the embodiment shown, the damper plate 350 is supported by at least one support bar 352. The support bar 352 extends from the base plate 302 on a first end to the damper plate 350 on an opposing end, and maintains relative positions of the two. The linear damper mechanism 300 may include a first and a second damper plate 350.

In use, as the hose 114 moves through the shank 150, the magnetic collar 230 on the hose approaches and contacts the base 302. The magnetic collar 230 prevents the hose from passing further through the base 302, and the magnetic attraction between the magnetic collar 230 and a magnet (not shown) on the base plate 302 prevents a "bounce" of the collar. Contact between the magnetic collar 230 on the hose 114 and the base 302 causes the hose 114 to decrease in speed, as the linear damper mechanism 300 takes effect. Specifically, the damper 306 reduces the speed that the faucet spray head 112 retracts, because the base 302 and damper plate 350 are moved "downward" with the magnetic collar 230, with the damper rod 314 being pressed downward into the damper body 312. Then, the damper rod 314 retracts back into the damper body 312 in a slow and controlled movement.

Also shown in the embodiment is a retention clip 370, which allows the linear damper mechanism 300 to be attached to the faucet 100. The retention clip 370 allows a user to install and remove the linear damper mechanism 300 from the faucet 100 as desired, thereby providing for retrofit capability of the linear damper mechanism 300. The retention clip 370 resides within the body portion 316 of the linear damper mechanism 300, and connects the linear damper mechanism 300 to a mounting shank of the faucet 100.

Figure 8B:
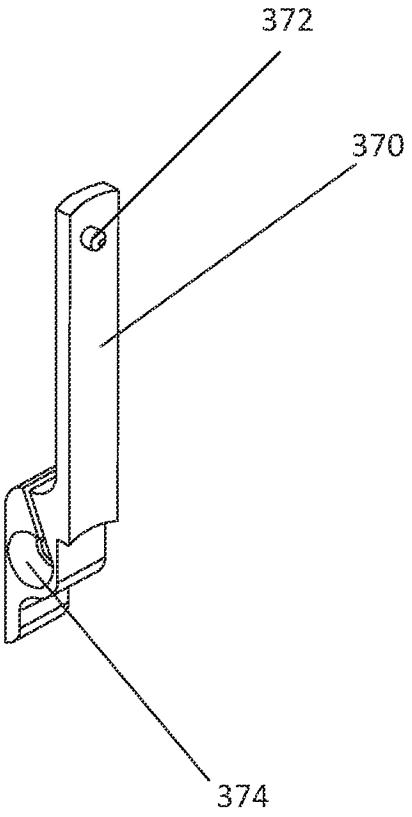
FIGS. 8*a* and 8*b* illustrate an embodiment of the linear damper mechanism and a retention clip.
Figure 8A:
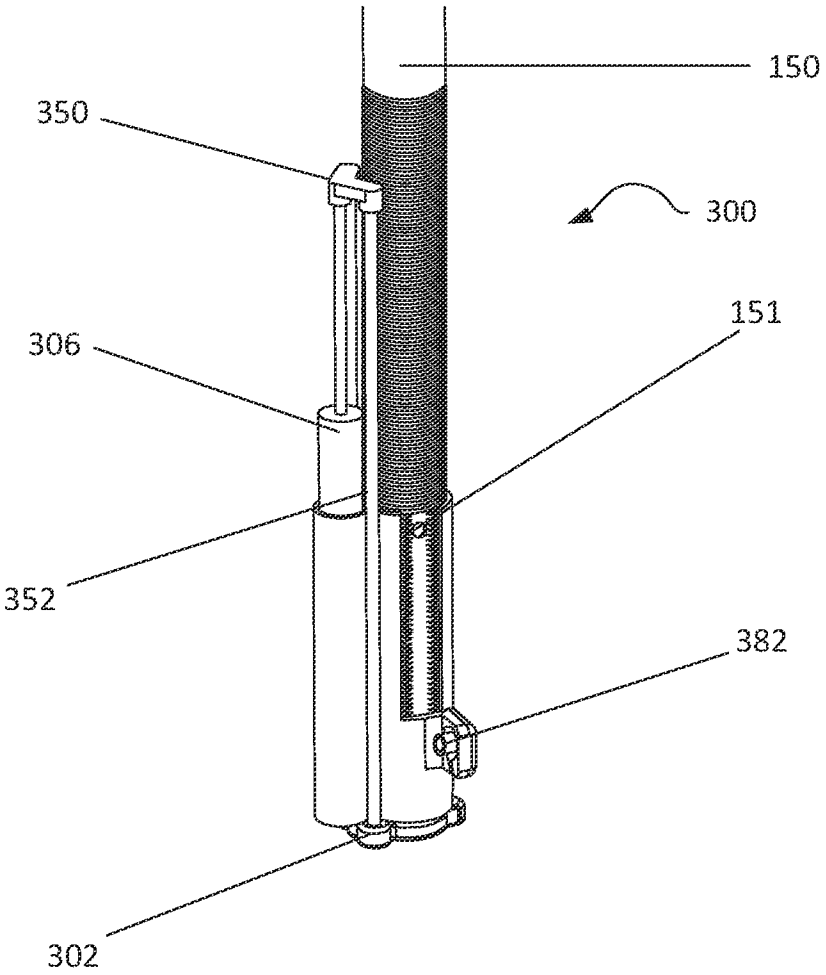

FIG. 8*a* illustrates an embodiment of the linear damper mechanism 300 without the retention clip 370 (shown in FIG. 7) attached, and FIG. 8*b* illustrates an isolated embodiment of the retention clip 370. The linear damper mechanism 300 includes a retention clip retainer 382 located adjacent the base plate 302. The faucet 100 includes a mounting shank 150, which houses the hose 114 and allows the hose 114 to move therewithin.

The retention clip 370 is capable of pivoting at the retention clip retainer 382 for installation and removal of the retention clip 370 from the linear damper mechanism 300. When the retention clip 370 is installed, a protrusion 372 of the retention clip 370 is retained within a recess 151 of the mounting shank 150 of the faucet 100.

FIG. 8*b* illustrates an isolated view of the retention clip 370. The retention clip 370 includes the protrusion 372 and a spring hub 374, which houses a spring (not shown). The protrusion 372 mates with a recess 151 of the threaded shank 150. The protrusion 372 maintains the linear damper mechanism 300 in a fixed position with the threaded shank 150, so that the linear damper mechanism 300 may slow the speed and provide control of the faucet spray head 112 and the hose 114 when moving from the extended position to the retracted position.

The retention clip 370 also includes the spring hub 374 which houses a spring. The spring is biased such that the equilibrium position biases the protrusion 372 of the retention clip 370 into the recess 151. If a user provides external force, the retention clip 370 can bias at the retention clip retainer 382, and the protrusion 372 is removed from the recess 151.

The soft-close feature described herein provides advantages such as preventing damage to a faucet when a user releases the faucet spray head. The soft-close feature reduces the speed at which the faucet spray head retracts when the faucet spray head nears the faucet spout. Therefore, damage, such as water leaks is prevented. Further, having a soft-close feature located within the faucet and/or below the deck provides an aesthetically pleasing design.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

The invention claimed is:

1. A faucet comprising:

a faucet base;

a faucet spout having an interior passage, a first end connected to the faucet base, and a second end;

a faucet spray head movable between a spray head retracted position in which the faucet spray head is proximate to the second end of the faucet spout and a spray head extended position positioned away from the second end of the faucet spout;

a hose extending through the interior passage of the faucet spout, the hose having a first end that is connected to a water source and a second end connected to the faucet spray head, the hose extending through the faucet spout;

a magnetic collar affixed to the hose;

a linear damper mechanism comprising:

at least one damper having a portion movable between a damper compressed position and a damper extended position; and a damper plate engaged to the at least one damper and having a bore sized to accept the hose and allow the hose to slide therethrough, the bore having a diameter smaller than a width of the magnetic collar, the damper plate including a magnet; and wherein, when the faucet spray head is in the spray head extended position, the at least one damper is moved to the damper extended position and as the faucet spray head is retracted toward the spray head retracted position, the at least one damper is engaged by contact between the magnetic collar and the damper plate, thereby slowing retraction of the faucet spray head until the faucet spray head is in the spray head retracted position and the at least one damper is in the damper compressed position.

2. The faucet of claim 1, wherein the linear damper mechanism is located at least partially below a sink deck of the faucet.

3. The faucet of claim 1, wherein the linear damper mechanism is located at least partially within the faucet base.

4. The faucet of claim 1, wherein the damper plate comprises a base plate.

5. The faucet of claim 1, wherein the damper plate comprises a linear damper bar, and the at least one damper is affixed to a portion of the faucet via a base plate, such that when the hose and the magnetic collar are moved between the spray head extended position and the spray head retracted position, the linear damper bar and an end of the at least one damper move relative to a damper body.

6. The faucet of claim 5, wherein the linear damper mechanism comprises a first damper and a second damper, and wherein the first damper is located on a first side of the linear damper bar and the second damper is located on a second side of the linear damper bar.

7. The faucet of claim 5, wherein the magnetic collar has an outer diameter that is greater than an inner diameter of a bore hole of the linear damper bar.

8. The faucet of claim 5, wherein in the spray head extended position, the linear damper bar is located at a maximum distance from the base plate.

9. The faucet of claim 5, wherein in the spray head retracted position, the linear damper bar is located at a minimum distance from the base plate.

10. The faucet of claim 1, further comprising a hose weight positioned along the hose between the water source and the faucet base.

11. The faucet of claim 10, wherein the hose weight has a weight greater than a weight of the faucet spray head.

12. A faucet comprising:

a faucet base;

a faucet spout having an interior passage, a first end connected to the faucet base, and a second end;

a faucet spray head movable between a spray head retracted position in which the faucet spray head is proximate to the second end of the faucet spout and a spray head extended position positioned away from the second end of the faucet spout;

a hose extending through the interior passage of the faucet spout, the hose having a magnetic collar attached to a first end that is connected to a water source and a second end connected to the faucet spray head, the hose extending through the faucet spout;

a linear damper mechanism comprising:

at least one damper having a portion movable between a damper compressed position and a damper extended position; and a base plate engaged to the at least one damper via a damper bar, the base plate having a bore sized to accept the hose and allow the hose to slide therethrough, the bore having a diameter smaller than a width of the magnetic collar, the base plate including a magnet; and wherein, when the faucet spray head is in the spray head extended position, the at least one damper is moved to the damper extended position and as the faucet spray head is retracted toward the spray head retracted position, the at least one damper is engaged by contact between the magnetic collar and the base plate, thereby slowing retraction of the spray head until the faucet spray head is in the spray head retracted position and the at least one damper is in the damper compressed position.

13. The faucet of claim 12, further comprising at least one support bar having a first end and a second end, the first end connected to the damper bar and the second end connected to the base plate.

14. The faucet of claim 12, further comprising a retention clip, wherein the retention clip removably connects the linear damper mechanism to a threaded shank of the faucet.

15. The faucet of claim 12, wherein the linear damper mechanism is located below a sink deck of the faucet.

16. The faucet of claim 12, wherein the magnetic collar is positioned at least partially adjacent the damper bar when the faucet spray head is located in the spray head retracted position.

17. The faucet of claim 12, wherein when the hose and the magnetic collar are moved between the spray head extended position and the spray head retracted position, the base plate, the damper bar, and an end of the at least one damper move relative to a damper body.

18. A soft-close faucet assembly comprising:

a magnetic collar fixedly attachable to a hose;

a linear damper mechanism having a body portion, a base portion, and a top portion, the linear damper mechanism comprising:

at least one damper having a first end and a second end, the second end connected to the base portion;

a linear damper bar housing a magnet, the linear damper bar located at the top portion and connected to the first end of the at least one damper, and wherein the linear damper bar is capable of moving relative to the base portion; and wherein the magnetic collar is movable relative to the linear damper mechanism as the hose is moved between a retracted position and an extended position, and wherein a viscous friction effect of the at least one damper reduces a retraction speed of a faucet spray head as the faucet spray head moves towards a spray head retracted position from a spray head extended position.

19. The soft-close faucet assembly of claim 18, wherein the magnetic collar is positioned at least partially within the linear damper bar in the retracted position.

20. The soft-close faucet assembly of claim 18, wherein when the magnetic collar is moved between the extended position and the retracted position, the linear damper bar and the second end of the at least one damper move relative to a damper body.

21. The soft-close faucet assembly of claim 18, wherein the linear damper bar comprises a bore hole capable of accepting the hose.

* * * * *